US006331110B1

(12) United States Patent
Steber et al.

(10) Patent No.: US 6,331,110 B1
(45) Date of Patent: Dec. 18, 2001

(54) EXTERNAL DILUTION AIR TUNING FOR DRY LOW $NO_X$ COMBUSTORS AND METHODS THEREFOR

(75) Inventors: Charles Evan Steber; Harmon Lindsay Morton, both of Simpsonville; Jacob Tussey McLeroy, Greenville, all of SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/578,663

(22) Filed: May 25, 2000

(51) Int. Cl.[7] ..... F23D 14/48; F02C 7/057

(52) U.S. Cl. ..... 431/352; 431/154; 431/190; 431/10; 60/759; 60/39.23

(58) Field of Search ..... 431/352, 351, 431/350, 154, 190, 2, 8, 10; 60/39.02, 759, 757, 752, 39.23

(56) References Cited

U.S. PATENT DOCUMENTS 3,927,520 * 12/1975 Arvin et al. ..... 60/39.23
3,930,368 * 1/1976 Anderson et al. ..... 60/39.23
4,301,657 * 11/1981 Penny ..... 60/759
4,389,848 * 6/1983 Markowski et al. ..... 431/352
5,235,805 * 8/1993 Barbier et al. ..... 60/759
5,240,404 * 8/1993 Hemsath et al. ..... 431/352
5,454,221 10/1995 Loprinzo ..... 60/759
5,664,412 * 9/1997 Overton ..... 60/39.23

FOREIGN PATENT DOCUMENTS

985058 * 3/1965 (GB) .
2 003 989-A * 3/1979 (GB) .

* cited by examiner

*Primary Examiner*—Ira S. Lazarus
*Assistant Examiner*—Josiah C. Cocks
(74) *Attorney, Agent, or Firm*—Nixon & Vanderhye

(57) ABSTRACT

Dilution sleeves are provided in radially aligned openings in the combustion liner and flow sleeve of a combustor for a gas turbine. The sleeves have a flange for seating on a collar of the flow sleeve about the opening therethrough enabling the dilution sleeve to extend through the aligned openings. A cover is removably mounted on the outer casing and a spring bears between the cover and the dilution sleeve flange to maintain the dilution sleeve in the openings. Dilution sleeves having different cross-sectional flow areas may be provided in lieu of initially installed dilution sleeves upon comparing measured emission levels with desired emission levels and ascertaining the desired increase or decrease in cross-sectional flow area through the dilution sleeves.

15 Claims, 3 Drawing Sheets

10
12
14
16
18
20
22
23
24
30
50
56
62
2
2

EXTERNAL DILUTION AIR TUNING FOR DRY LOW $NO_X$ COMBUSTORS AND METHODS THEREFOR

BACKGROUND OF THE INVENTION

The present invention relates to apparatus and methods for adjusting the $NO_x$ level of emissions of heavy-duty gas turbines for emissions compliance without disassembly of the combustors and particularly relates to a mechanical arrangement enabling external access to the dilution air sleeves for the combustion chamber for adjusting the combustor dilution air flow hole areas and methods of adjustment.

Heavy-duty gas turbines employing dry low $NO_x$ combustion systems are typically installed with predetermined dilution flow hole areas for flowing compressor discharge air into the combustion liner to shape the gas temperature profile exiting the combustion system and provide reduced $NO_x$ emissions. Dilution air flow sleeves are typically provided and have a predetermined hole area for flowing compressor discharge air into the combustion liner. Not infrequently, however, and after installation of the turbine at the power generation site, the $NO_x$ emissions level is either too high or too low, with corresponding CO emissions level that is too high. This is a result of the normal variability of machine air flow fraction that is delivered to the combustor and the resulting variability of flame temperature in the $NO_x$ producing zones of the combustor.

Under those circumstances, the turbine is typically brought into $NO_x$ emissions compliance by removal of the combustion liners from the turbine and resizing the dilution holes to redistribute the combustor air flow. This procedure requires the physical removal of the combustion liner from the turbine with attendant removal of certain piping for fuel, as well as piping for oil and water systems and auxiliary air piping for atomization. It is also necessary to remove the heavy end cover of the combustor to gain access to the dilution holes. Further, there is the possibility of contaminating the fuel system in the process of removing and reassembling the various piping systems. Still further, this process can take between one to two weeks' time, during which there is a gas turbine outage, preventing the electricity provider from producing power during that period of time. Consequently, there is a need for a system which facilitates change of the combustor dilution hole areas without disassembly and subsequent reassembly of major portions of the combustor and in a reduced timeframe.

BRIEF SUMMARY OF THE INVENTION

In accordance with a preferred embodiment of the present invention, there is provided a mechanical arrangement enabling external access to the combustion chamber which facilitates changeover of combustor dilution hole areas to adjust the $NO_x$ levels without disassembly of the combustors. To accomplish this, the combustion liner and surrounding air flow sleeve have aligned radial openings at an axial location along the liner for admitting dilution air through dilution sleeves in the aligned radial openings into the combustion chamber. An outer casing surrounds the flow sleeve and defines with the flow sleeve an annular flow passage for flowing compressor discharge air through the dilution sleeves into the combustion chamber. The openings through the flow sleeve are provided with collars which form seats for receiving flanges of the dilution sleeves. The outer casing is also provided with a cylindrical boss or flange in line with the axes of the openings through the combustion liner and flow sleeve, affording access to the dilution sleeves externally of the combustor. A cover is releasably secured to the cylindrical flange, for example, by bolts, and a spring cooperates between the cover and the flange on each dilution sleeve to maintain the dilution sleeve in the aligned openings of the combustion liner and flow sleeve with the flange of the dilution sleeve seated on the collar.

Each dilution sleeve has a central opening of a predetermined area. In the event that the $NO_x$ emissions are out of compliance after initial installation of the gas turbine, the access covers to the installed dilution sleeves are removed and dilution sleeves having holes of different areas are inserted to provide more or less compressor discharge air flow through the sleeves into the combustion chamber. Particularly, after the $NO_x$ emissions of the newly installed turbine have been measured at the design operating conditions, the actual measured $NO_x$ emission level is compared with the required $NO_x$ emission level for compliance. If the measured $NO_x$ emissions deviate to the extent the turbine is out of compliance, an increase or decrease in the hole area of the installed dilution sleeves is calculated to arrive at a dilution hole area effective to provide a $NO_x$ emission level within the compliance range. Once the required dilution hole area is determined, the combustion covers are removed and a new set of dilution sleeves conforming to the new required hole area is provided. Alternatively, the initially installed set of dilution sleeves are machined to the required new dilution hole areas. In either case, the dilution sleeves with the required hole areas are inserted through the cylindrical bosses to seat on the collars about the openings in the flow sleeve and extend through the aligned openings through the flow sleeve and the combustion liner. The springs and covers are then reinstalled to secure the dilution sleeves in place with the properly sized dilution hole areas.

In a preferred embodiment according to the present invention, there is provided a combustor for a gas turbine comprising an outer casing, a flow sleeve within the outer casing defining an air flow passage with the outer casing, a combustion liner within the flow sleeve for flowing hot gases of combustion, at least one opening in each combustion liner and the flow sleeve, a dilution sleeve removably received within the openings of the combustion liner and the flow sleeve and an access port in the outer casing for access to the dilution sleeve, the dilution sleeve being sized for passage through the access port enabling insertion into or removal of the dilution sleeve from the openings.

In a further preferred embodiment according to the present invention, there is provided in a combustor for a gas turbine having a combustion liner defining a hot gas flow path, an outer casing, a flow sleeve between the outer casing and the liner defining a dilution air flow path therebetween, and openings through the flow sleeve and the liner for flowing dilution air in the dilution air flow path into the hot gas flow path, a method of adjusting the level of $NO_x$ emissions comprising the steps of (a) providing a dilution air flow sleeve in the openings having an air flow passage of a predetermined area, (b) measuring the $NO_x$ emissions from the gas turbine at design operating conditions, (c) determining a deviation of the measured $NO_x$ emissions from a predetermined desired level of $NO_x$ emissions, (d) ascertaining a predetermined area of a desired air flow passage through an air flow dilution sleeve based on the deviation and (e) installing an air flow dilution sleeve in the turbine having a flow area sized to provide at least approximately the desired level of $NO_x$ emissions.

DETAILED DESCRIPTION OF THE INVENTION

Figure 1:
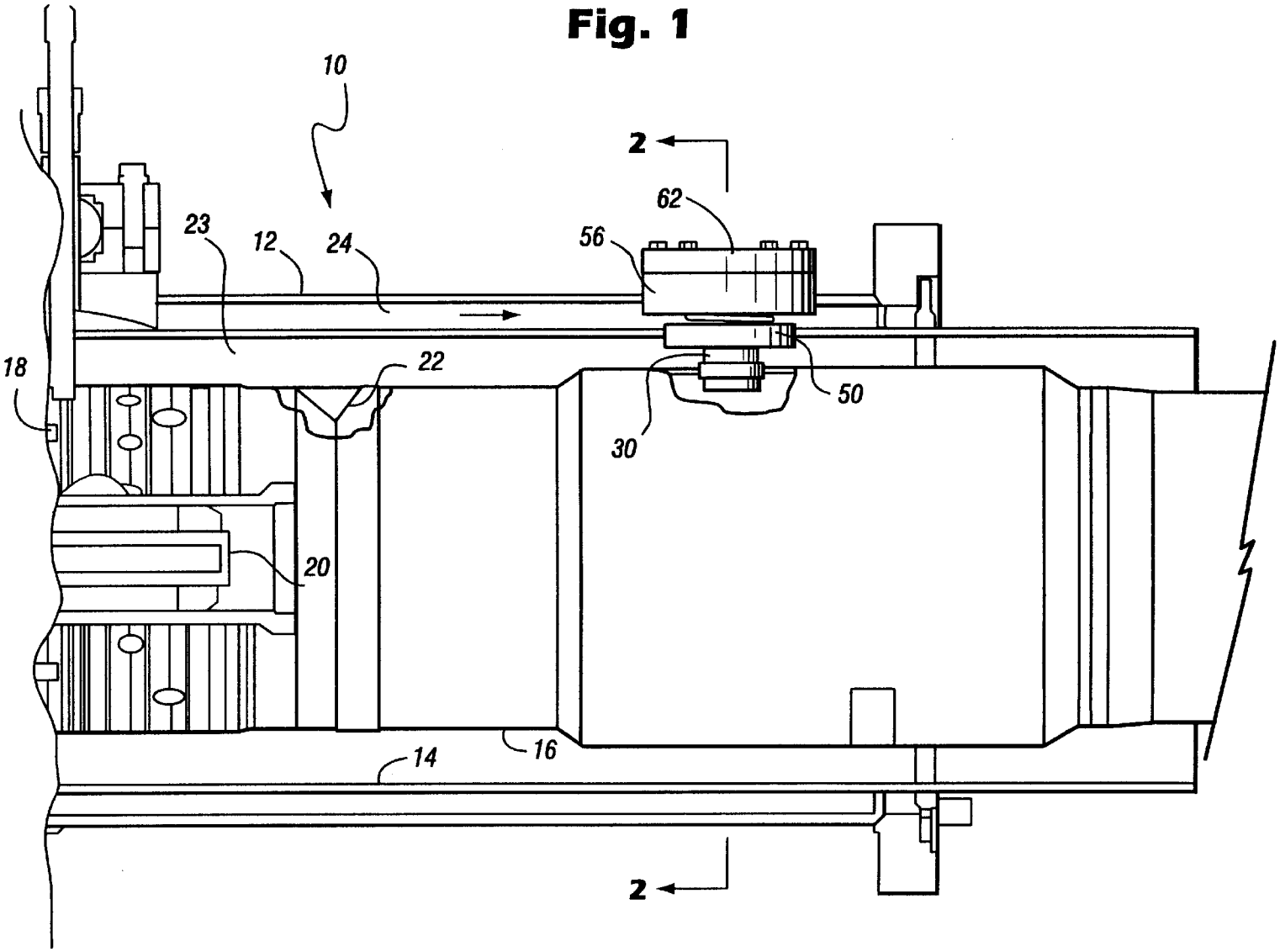
FIG. 1 is a fragmentary cross-sectional view of a combustor for a gas turbine illustrating a dilution sleeve for flowing dilution air into the combustion chamber constructed in accordance with a preferred embodiment of the present invention.
Figure 2:
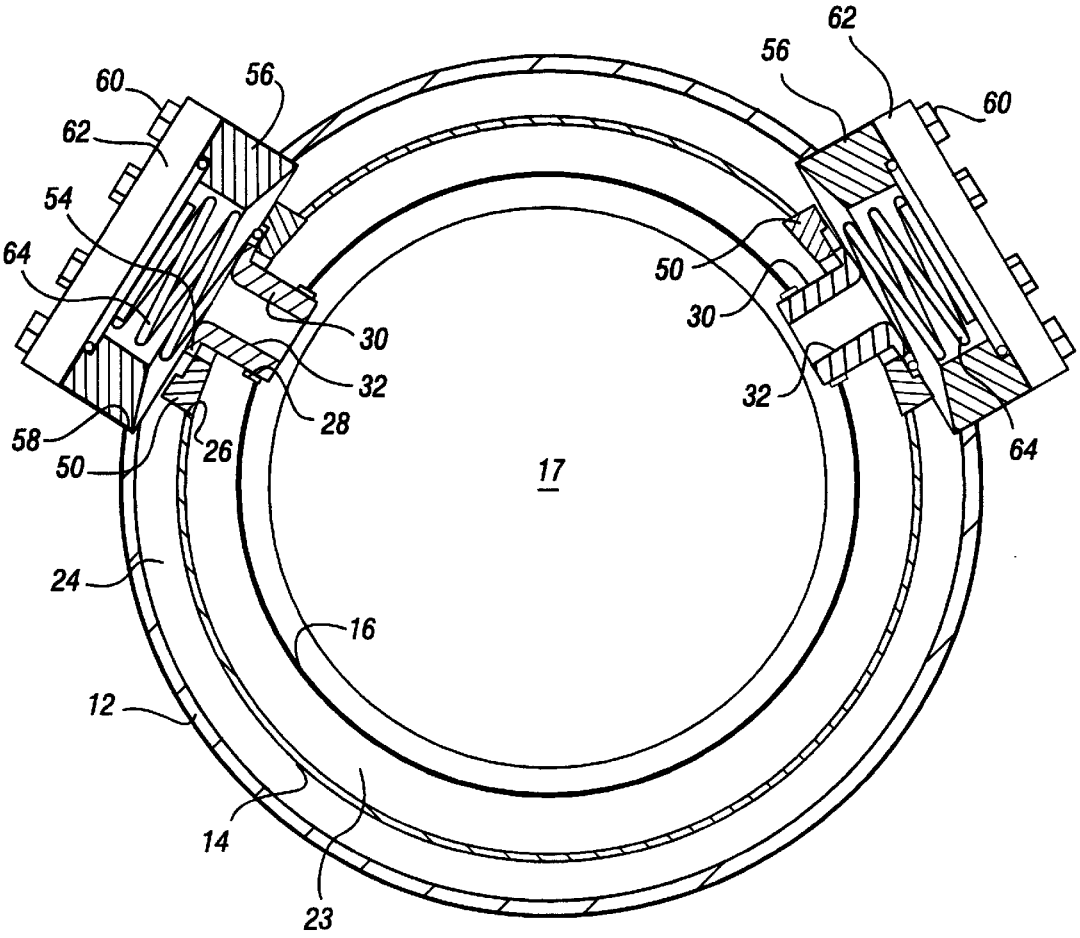
FIG. 2 is a cross-sectional view thereof taken generally about on line 2—2 in FIG. 1.

Referring now to the drawings, particularly to FIG. 1, there is illustrated a dry low $NO_x$ combustor, generally designated 10, comprised of a combustor outer casing 12, a flow sleeve 14, generally concentrically within the outer casing 12, and a flow liner 16 for confining the hot gases of combustion in a hot gas flow path 17 (FIG. 2). Additionally illustrated are primary and secondary fuel nozzles 18 and 20, respectively, and a venturi 22. It will be appreciated that fuel is supplied to the nozzles 18 or 20 and the hot gases of combustion are generated for flow generally axially downstream within the combustion liner 16 and into the first stage of a gas turbine, not shown. As conventional, cooling air is supplied along an annular passage 23 between the combustion liner 16 and flow sleeve 14 for flow into the reaction chamber. A proportion of compressor discharge air also flows in the annular passage 24 between the outer casing 12 and the flow sleeve 14 in the direction of the arrow for supplying dilution air into the reaction chamber.

Figure 4A:
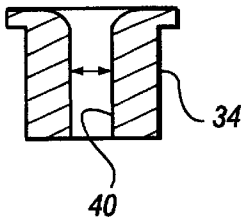
FIGS. 4A, 4B and 4C illustrate a set of dilution sleeves of identical outside diameters and with different inside diameters affording different dilution sleeve flow areas.
Figure 4B:
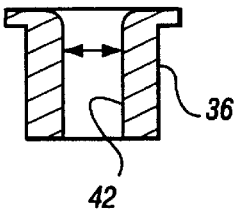
Figure 4C:
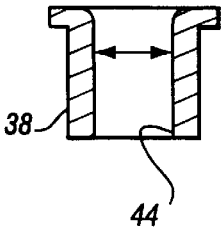

Referring to FIG. 2, the dilution air is provided through openings 26 and 28 in the flow sleeve 14 and combustion liner 16, respectively. In FIG. 2, two sets of openings 26 and 28 are radially aligned at circumferentially spaced positions about the combustor for receiving the compressor discharge dilution air in annular passage 24. Dilution flow sleeves 30 extend through the aligned openings 26 and 28 for directing the dilution air into the combustion chamber, the dilution sleeves 30 having central openings 32 of predetermined flow areas. By changing the flow areas of the dilution sleeves 30, i.e., the flow areas of openings 32, the level of $NO_x$ emissions can be changed. For this purpose, and as illustrated in FIGS. 4A, 4B and 4C, a set of dilution sleeves 34, 36, 38, etc. are provided, each sleeve having a central opening of different diameter and hence different cross-sectional area. As illustrated, central openings 40, 42, 44 of sleeves 34, 36, 38, respectively, have different areas and, consequently, when used in the combustor, have the effect of increasing or decreasing the level of emissions. It will be appreciated that while only three flow sleeves having central openings of different areas are illustrated in FIGS. 4A, 4B and 4C, any number of flow sleeves 30 with different incremental sizes of the central openings 32 can be provided. Alternatively, a single set of flow sleeves are provided with the initially installed turbine. Those sleeves can be removed from the turbine as set forth herein, machined to provide the desired flow area and reinstalled into the turbine in accordance with the present invention.

To enable external access to the dilution sleeves to mechanically adjust the dilution air flow into the combustion chamber, each opening 26 through the flow sleeve 14 is provided with a collar 50 secured to sleeve 14. The collar 50 forms a seat for receiving the flange 54 of the dilution sleeve 30, it being appreciated that as illustrated, the cylindrical dilution sleeve 30 extends from flange 54 through openings 26 and 28 in the flow sleeve 14 and combustion liner 16, respectively, for delivering dilution air to the combustion chamber. To retain the sleeve 30 in the radially aligned openings 26 and 28, a cylindrical boss or flange 56 is provided on the outer casing 12 about an access port or opening 58. The opening 58 lies in radial alignment with the openings 26 and 28. The cylindrical boss 56 terminates at an outer annular end face in bolt holes to receive bolts 60 for securing a cover 62 to the boss 56. An element 64, preferably a helical coil spring, extends between the outer casing 12, and particularly between the cover 62 and the flange 54 of each dilution sleeve 32 to maintain the sleeve seated on collar 50 and extending into the aligned openings 26 and 28. It will be appreciated that preferably a pair of dilution sleeves, aligned openings, covers, seals and springs are provided as illustrated in FIG. 2 at circumferentially spaced locations about the combustor, each identical to the other.

To change over from one set of dilution sleeves having a predetermined flow area to another set of dilution sleeves having a different flow area, it will be appreciated that the covers 62 may be removed by unthreading the bolts 60 from the boss 56. The springs 64 and sleeves 30 are therefore accessible externally of the combustor and are removed. Thus, the removed sleeves can be replaced by sleeves having the same outside diameters but having appropriately sized openings 32. Alternatively, the removed sleeves 30 can be machined to provide openings of different cross-sectional area or their openings can be reduced in size by inserting and welding a further sleeve within the dilution sleeve. With the sleeves having the appropriate sized dilution flow openings installed and seated on collars 50, the covers 62 and springs 64 are then reapplied to the outer casing with the springs maintaining the sleeve in position on collars 50. It will be appreciated that the compressor discharge air flowing in the annular chamber 24 flows between the collars 50 and bosses 56 past the dilution sleeve flanges 54 and through the openings 32 of the sleeves 30 into the combustion chamber.

Figure 3:
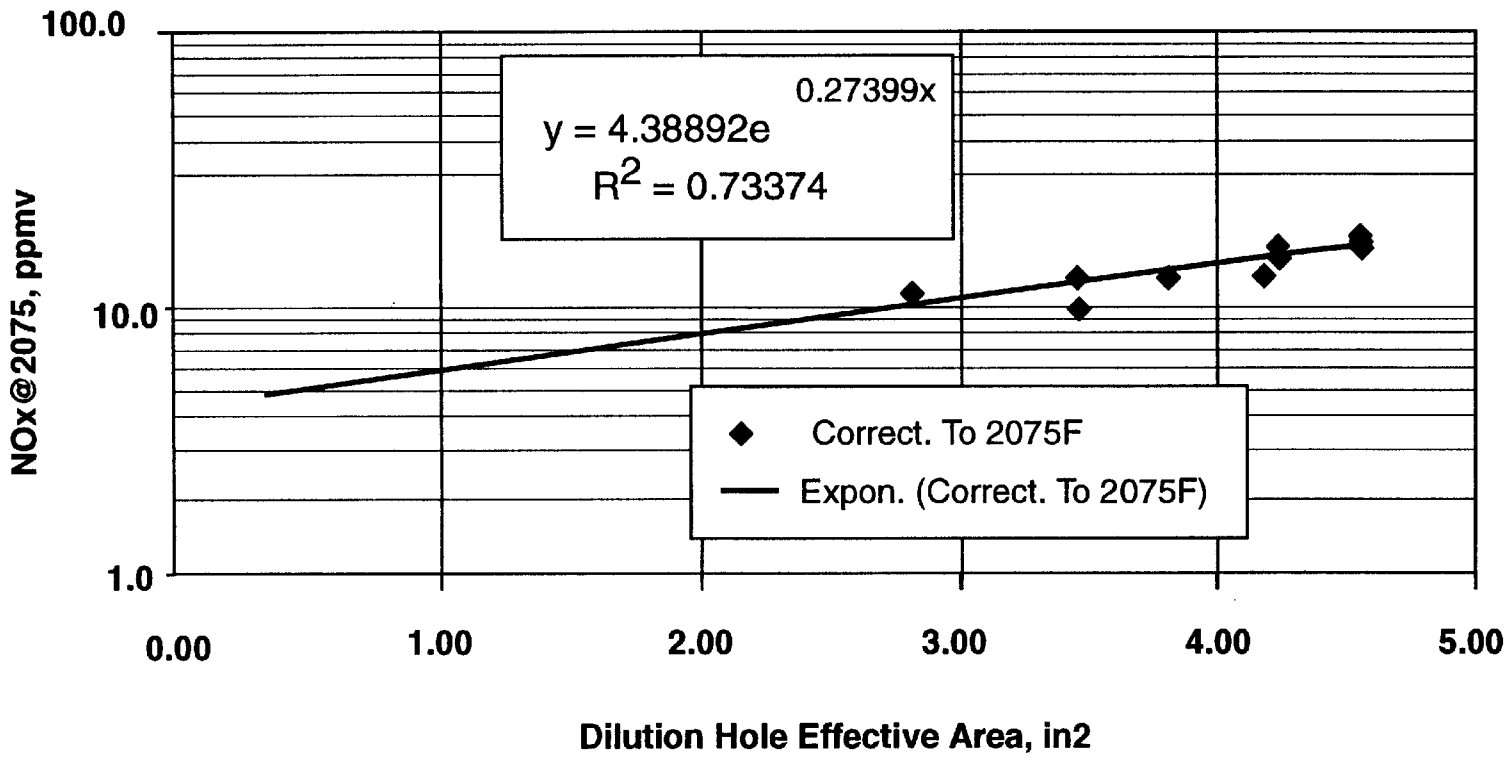
FIG. 3 is a graph of the $NO_x$ emissions versus dilution hole effective area by which the required hole area for $NO_x$ emissions in compliance can be determined.

Upon initial installation of the gas turbine, the $NO_x$ emissions are measured. If the emissions are out of compliance with predetermined required emission levels, dilution sleeves having central openings with different cross-sectional areas are substituted for the dilution sleeves provided initially with the gas turbine or the initially provided dilution sleeves are modified, e.g., by machining, to provide dilution sleeves having central openings of appropriate area. If the deviation between the measured level of $NO_x$ emissions renders the turbine out of compliance, the desired change in dilution hole effective area can be calculated and a new dilution hole area determined. A graph, typical to the graph illustrated in FIG. 3, may also be used to determine the desired change in dilution hole effective area and, consequently, the required dilution hole diameter whereby the extant dilution sleeves can be replaced by properly sized dilution sleeves or modified to obtain the desired dilution flow area. Through calculation or by employing the chart, the change in area of the dilution flow sleeve central openings from the flow area of the initially installed dilution sleeves to flow areas required to obtain a desired emission level can be ascertained. The chart is a plot of $NO_x$ emissions for a Frame 6B heavy duty gas turbine fired at 2,075° F. in parts per million versus dilution hole effective area in square inches, e.g., the chart being corrected for the firing temperature of 2075° F. Using the equation given on the chart, for a given measured $NO_x$ emission, the dilution hole effective area can be calculated to achieve a desired level of emissions. For example, the log of the measured $NO_x$ divided by dilution hole effective area=0.27399. This implies that for a 10% increase in $NO_x$ emission levels, the increase in dilution hole effective area would be log In (1.10) divided by 0.27399=0.3479 inches$^2$. Consequently, with this calculated or graphically obtained increase in dilution hole effective area, the dilution hole area necessary to bring the $NO_x$ emissions level into compliance is obtained. Similar graphs corrected using calculations or experimental data would be applied to larger or smaller gas turbine combustion systems. A set of sleeves having a dilution hole area approximating or corresponding to the desired hole area can then be selected from dilution sleeve sets of different diameters, for example, those illustrated in FIGS. 4A–4C and installed to provide dilution sleeves having desired flow area. Typically, where sets of dilution sleeves are provided, the desired change in area from the extant dilution sleeve will not correspond exactly with the increments in cross-sectional hole areas of the sets of dilution sleeves. Accordingly, given the change in effective area necessary, a set of dilution sleeves which approximates the desired effective area, whether on the high or low side of the calculated change in area, may be used. Alternatively, the extant dilution sleeves may be removed and machined or material added as necessary to achieve the desired flow area. Once the dilution flow sleeves having the desired flow areas are identified, they are installed as previously discussed.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A combustor for a gas turbine comprising:

an outer casing;

a flow sleeve within said outer casing defining an air flow passage with said outer casing;

a combustion liner within said flow sleeve for flowing hot gases of combustion;

at least one opening in each said combustion liner and said flow sleeve;

a dilution sleeve removably received within said openings of said combustion liner and said flow sleeve; and an access port in said outer casing for access to said dilution sleeve, said dilution sleeve being sized for passage through said access port enabling insertion into or removal of said dilution sleeve from said openings.

2. A combustor according to claim 1 wherein said openings are substantially radially aligned with one another, and a seat carried by said flow sleeve about the opening in said flow sleeve, said dilution sleeve including a flange for seating on said seat.

3. A combustor according to claim 1 wherein said openings are substantially radially aligned with one another, an access port cover for securement to said outer casing closing said access port, and an element engageable between said outer casing and said dilution flow sleeve for maintaining said dilution flow sleeve in said aligned openings.

4. A combustor according to claim 3 including a seat carried by said flow sleeve about the opening in said flow sleeve, said dilution sleeve including a flange for seating on said seat.

5. A combustor according to claim 4 wherein said element includes a spring cooperable between said cover and said dilution flow sleeve for maintaining said dilution flow sleeve in said aligned openings.

6. A combustor according to claim 1 including a second opening in each of said combustor liner and said flow sleeve, a second dilution sleeve removably received within said second openings of said combustion liner and said flow sleeve, a second access port in said outer casing for access to said second dilution sleeve, said second dilution sleeve being sized for passage through said access ports enabling insertion into or removal of said second dilution sleeve from said second openings.

7. A combustor according to claim 6 wherein the first mentioned openings are substantially radially aligned with one another, said second openings beings substantially radially aligned with one another, first and second seats carried by said flow sleeve about respective first and second openings, said first and second dilution sleeves including a flange for seating about said first and second seats, respectively.

8. A combustor according to claim 6 wherein the first mentioned openings are substantially radially aligned with one another, said second openings being substantially radially aligned with one another, first and second access port covers for securement to said outer casing closing said respective access ports, and first and second elements engageable between said outer casing and said first and second dilution flow sleeves, respectively, for maintaining said dilution flow sleeves in said aligned openings.

9. A combustor according to claim 8 wherein said elements comprise springs engageable between said covers and said dilution flow sleeves for maintaining said dilution flow sleeves in said aligned openings.

10. A combustor according to claim 8 wherein said elements comprise springs for biasing said dilution flow sleeves against seats about the first and second openings in said flow sleeve.

11. In a combustor for a gas turbine having a combustion liner defining a hot gas flow path, an outer casing, a flow sleeve between said outer casing and said liner defining a dilution air flow path therebetween, and openings through said flow sleeve and said liner for flowing dilution air in said dilution air flow path into the hot gas flow path, a method of adjusting the level of $NO_x$ emissions comprising the steps of:

(a) providing a dilution air flow sleeve in said openings having an air flow passage of a predetermined area;

(b) measuring the $NO_x$ emissions from the gas turbine at design operating conditions;

(c) determining a deviation of the measured $NO_x$ emissions from a predetermined desired level of $NO_x$ emissions;

(d) ascertaining a predetermined area of a desired air flow passage through an air flow dilution sleeve based on said deviation; and (e) installing an air flow dilution sleeve in the turbine having a flow area sized to provide at least approximately the desired level of $NO_x$ emissions.

12. A method according to claim 11 including providing sets of air flow sleeves having predetermined air flow passages of different areas therethrough and selecting one of the sleeves having a predetermined flow area sized to approximately provide the desired level of $NO_x$ emissions.

13. A method according to claim 11 including, after step (b), removing the dilution sleeve provided in step (a).

14. A method according to claim 11 wherein the flow dilution sleeve installed in the turbine in step (e) comprises the dilution air flow sleeve of step (a) modified to provide said flow area of step (e).

15. A method according to claim 11 including, after step (b), removing the dilution sleeve provided in step (a), and selecting an air flow dilution sleeve sized to provide at least approximately the desired level of $NO_x$ emissions from sets of dilution sleeves having different flow areas.

* * * * *